United States Patent [19]

Kohyama

[11] Patent Number: 4,508,052

[45] Date of Patent: Apr. 2, 1985

[54] DEVELOPING DEVICE

[75] Inventor: Mitsuaki Kohyama, Tokyo, Japan

[73] Assignee: Tokyo Shibaura Denki Kabushiki Kaisha, Kawasaki, Japan

[21] Appl. No.: 521,642

[22] Filed: Aug. 9, 1983

[30] Foreign Application Priority Data

Aug. 16, 1982 [JP] Japan ..... 57-141940

[51] Int. Cl.[3] ..... G03G 15/06

[52] U.S. Cl. ..... 118/651; 118/658

[58] Field of Search ..... 118/651, 658

[56] References Cited

U.S. PATENT DOCUMENTS 4,164,372 8/1979 Gundlach et al. ..... 355/3 DD 4,370,049 1/1983 Kuge et al. ..... 118/651

FOREIGN PATENT DOCUMENTS 54-43038 4/1979 Japan .

*Primary Examiner*—Bernard D. Pianalto

*Attorney, Agent, or Firm*—Cushman, Darby & Cushman

[57] ABSTRACT

A developing device is provided with a nonmagnetic sleeve being rotatable and buried in a mixture of a nonmagnetic toner and a magnetic carrier in a casing. A magnet is contained in the sleeve so that a magnetic brush is formed from the mixture on the sleeve. A developing roller is disposed rotatable between the sleeve and a photosensitive drum, and is separated from the drum and in contact with the magnetic brush. A power source is connected to the roller and the sleeve to generate an electric field between the same so that the toner electrostatically attracted to the sleeve is transferred to the roller. Thus, the toner attracted to the roller is carried close to the drum as the roller rotates, and is attracted to the electrostatic latent image by a surface potential defined by the latent image to develop the latent image.

8 Claims, 5 Drawing Figures

DEVELOPING DEVICE

BACKGROUND OF THE INVENTION

The present invention relates to a developing device for developing an electrostatic latent image on an electrostatic latent image-forming surface into a visible image, and more specifically, to a developing device capable of supplying a developer to an electrostatic latent image-forming surface while held in contact with the image-forming surface.

In dry electrophotography, the developing process is the most critical factor of all influencing the quality of picture. Conventional developing processes include a cascade method, magnetic brush method, and many other systems including modifications of these methods.

Among these systems, the cascade method and magnetic brush method are most frequently used in ammonia process diazo copying machines for business use. These methods are preferred because they facilitate frictional charging of toner and ensure clear copy images.

However, the cascade method is subject to a defect in that peripheral effects produced at the time of developing lower the reproducibility of the solid sections of images. The magnetic brush method, which is free from such a defect, is the most popular system. In the magnetic brush method, however, the working life of the carrier of the developer is relatively short, and the carrier usually must be replaced by new one every time several tens of thousand copies are made.

In order to eliminate the defects of these two methods, the carrier must be improved in shape and material. However, this improvement has not yet been accomplished. In these circumstances, developing systems which use the so-called one-component magnetic developers have been increasingly used. Some of these developing systems use conductive toner, while others employ insulating toner. If one wishes to use ordinary paper as the transfer paper, it is technically advisable to choose the insulating toner for developing, because the aforesaid developing systems involve the following problems. Since it is hard to stably charge the toner, irregular image formation, fogging, variations in concentration and other defects in image or picture will occur. Thus, the use of the insulating, magnetic one-component developer constitutes a hindrance to the manufacture of highly sophisticated copying machines.

Another advantage of the development system using the one-component developer lies in the fact that the toner can develop an electrostatic latent image even though it is not in contact with an electrostatic latent image-forming surface. This advantage is an important factor in the color copying technique which requires superposed development. However, it is difficult to color magnetic toner, since magnetic powder used for the toner is black or brown, and will spoil other colors.

The demand for color copies has greatly increased the need for a developing system which can perform satisfactory color developing using nonmagnetic toner. However, the so-called nonmagnetic, one-component development system is too unsophisticated to be applied to copying machines. According to this system, as is generally known, a thin layer (50 microns or less) or nonmagnetic toner is formed on the surface of a conductive roller, and is opposed to an electrostatic latent image-forming surface such as a photosensitive body, with an electrostatic latent image thereon, with a gap of about 60 microns or less between them. First, as regards this developing system, no reliable means has yet been developed for forming the thin layer of toner. Under the present conditions, the most popular method is one in which the toner is passed between the surface of the conductive roller and, e.g., a rubber blade pressed against the same as disclosed, for example, in U.S. Pat. No. 4,232,628. However, this method has several problems, such as uneven thickness of toner layer, abrasion of blade, etc. Secondly, the thin toner layer formed in this manner must have uniform charges. According to the conventional developing system, moreover, the charging probability of toner is too low to ensure good and stable charging, and the quality of image produced is very poor. Accordingly, tests are being made to improve the nonmagnetic toner in both charging property and filming capability. However, this improvement greatly depends on the material conditions, and is still in an experimental stage. This also holds true of the improvement of the frictional charging capability of the nonmagnetic toner on the surface of the conductive roller.

As "intelligent" copying machines have recently been developed, there has been a demand for switching means for the normal and reverse developing processes. Presently, however, no effective means for that purpose exists.

SUMMARY OF THE INVENTION

The present invention is contrived in consideration of these circumstances, and is intended to provide a developing device capable of developing an electrostatic latent image formed on an electrostatic latent image-forming surface by means of a nonmagnetic, one-component developer kept out of contact with the electrostatic latent image-forming surface.

According to one aspect of the invention, there is provided a developing device which develops an electrostatic latent image on an electrostatic latent image-forming surface of an image carrier by means of a nonmagnetic toner, comprising a casing containing a mixture of the nonmagnetic toner and a magnetic carrier; a hollow cylindrical body formed of a non-magnetic material and rotatable in a position such that part of the hollow cylindrical body is buried in the mixture of the nonmagnetic toner and the magnetic carrier in the casing; a magnet contained in the hollow cylindrical body so that a magnetic brush is formed from the mixture of the nonmagnetic toner and the magnetic carrier on the outer peripheral surface of the hollow cylindrical body by the magnetic force of the magnet as the hollow cylindrical body rotates; a developing roller rotatable in a gap between the hollow cylindrical body and the electrostatic latent image-forming surface of the image carrier, the developing roller having a portion separated from the electrostatic latent image-forming surface and a portion in contact with the magnetic brush formed on the outer peripheral surface of the hollow cylindrical body; and voltage applying means connected to the developing roller and the hollow cylindrical body to generate an electric field between the same so that the nonmagnetic toner is electrostatically attracted to the outer peripheral surface of the hollow cylindrical body, whereby the nonmagnetic toner attracted to the outer peripheral surface of the hollow cylindrical body is carried close to the electrostatic latent image-forming surface as the hollow cylindrical body rotates, and is attracted to the electrostatic latent image by a surface potential defined by the latent image to develop the latent image.

DETAILED DESCRIPTION OF THE PREFERRED EMBODIMENT

One embodiment of the developing device of the present invention used in an electronic copying apparatus will now be described in detail with reference to the accompanying drawings.

Figure 1:
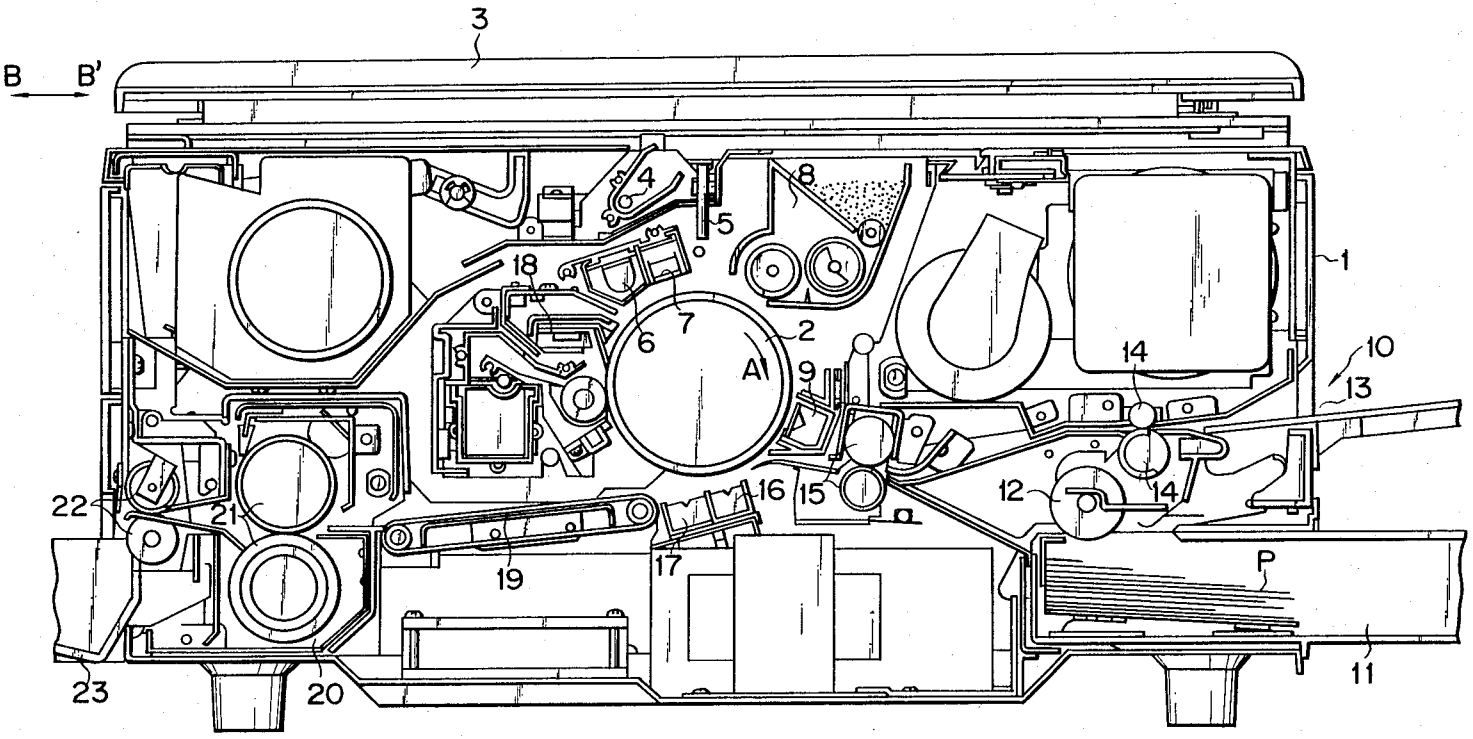
FIG. 1 is a side view schematically showing an electronic copying apparatus using a developing device according to one embodiment of the present invention.

In FIG. 1, numeral 1 designates a housing of the electronic copying apparatus. Disposed in the central portion of the housing 1 is a photosensitive drum 2 (image carrier) of e.g., selenium-tellurium alloy, which can rotate in the direction of arrow A of FIG. 1. An original table 3 overlies the housing 1 so that it can reciprocate in the directions of arrows B and B', carrying an original sheet. An exposure lamp 4 is disposed under the original table 3 to apply light to the original paper on the original table 3. As the original table 3 moves, the exposure lamp 4 irradiates over the length and breadth of the original paper. Reflected light from the original paper is projected on the surface of the photosensitive drum 2 through an optical lens array 5 for exposure.

Arranged in the direction of arrow A around the photosensitive drum 2 are a cold cathode discharging lamp 6 which emits a blue light to properly fatigue and erase an afterimage, and a DC corona charger 7 which charges the surface of the photosensitive drum 2 with a positive voltage (approx. 800 V). After being deelectrified and charged by the cold cathode discharging lamp 6 and the DC corona charger 7, the surface of the photosensitive drum 2 is exposed to the light reflected from the original paper to form thereon an electrostatic latent image corresponding to the original. On the lower-course side of the charger 7 with respect to the rotating direction of the photosensitive drum 2, there are successively arranged a developing device 8 which develops the electrostatic latent image by means of a developer (hereinafter referred to as toner), an AC corona discharger 9 which deelectrifies the photosensitive drum 2 and charges the toner on the photosensitive drum 2 with a fine voltage (negative), and a paper feeder 10 which feeds copying paper to the region under the photosensitive drum 2.

The paper feeder 10 is provided with a paper cassette 11 which contains a plurality of sheets of copying paper P and can be detached from one side portion of the housing 1, a feed roller 12 for drawing out the sheets of paper P one by one from the paper cassette 11 into the housing 1, a manual feed mechanism 13 over the paper cassette 11, a pair of feed rollers 14 for feeding paper P from the manual feed mechanism 13 into the housing 1, and a pair of aligning rollers 15 for feeding the paper P from the paper cassette 11 or the manual feed mechanism 13, positioning the forward edge of the paper P. On the lower-course side of the paper feeder 10 with respect to the paper feed direction, there are arranged a transfer charger 16 for transferring a visible image on the surface of the photosensitive drum 2 to the surface of the paper P fed by the aligning rollers 15, and a separating charger 17 for separating the paper P with the visible image thereon from the surface of the photosensitive drum 2. A cleaning device 18 for collecting toner remaining on the surface of the photosensitive drum 2 at the conclusion of the transfer process is disposed on the lower-course side of the separating charger 17 with respect to the rotating direction of the photosensitive drum 2.

The paper P is separated after the transfer and is carried to fixing device 20 by a conveyor belt 19. In the fixing device 20, the visible image transferred to the paper P is fixed on the paper P by a pair of heat rollers 21. The paper P fixed by the fixing device 20 is fed by a pair of discharge rollers 22 into a discharge tray 23 on the other side portion of the housing 1.

Figure 2:
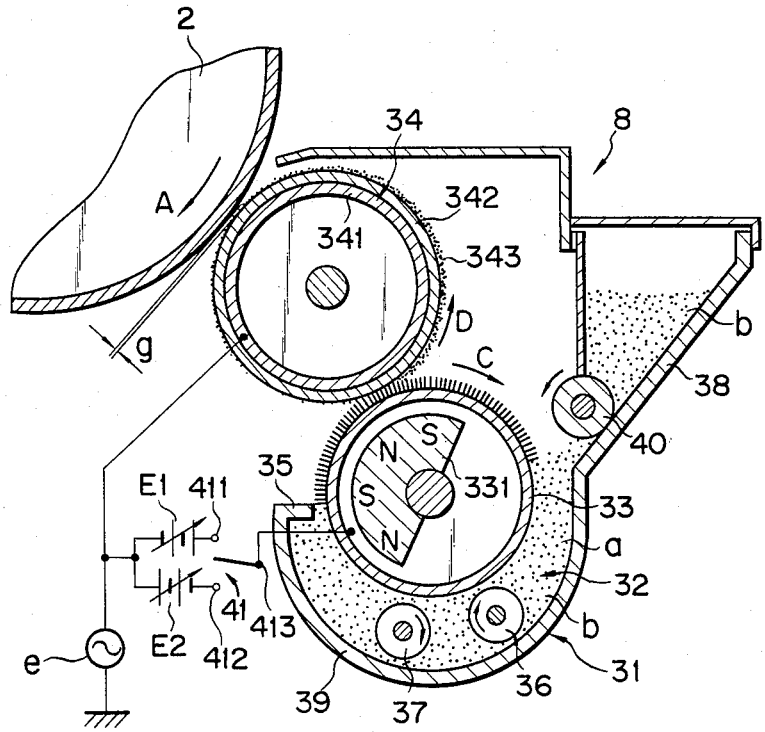
FIG. 2 is a side sectional view extractively showing the developing device.

Referring now to FIG. 2, the construction of the developing device 8 will be described in detail. The developing device 8 has a casing 31 which is provided with a toner hopper 38 and a developer reservoir 39. The casing 31 contains developer 32 composed of a magnetic carrier a (iron powder, ferrite, etc.) and a nonmagnetic toner b (2 to 7% by weight) capable of being negatively charged. Housed in the casing 31 is a nonmagnetic cylindrical sleeve 33 (developer conveyor roller) which rotates in the direction of arrow C of FIG. 2, partially buried in the developer 32 in the developer reservoir 39. A developing roller 34 rotating in the direction of arrow D is provided between the cylindrical sleeve 33 and the photosensitive drum 2. A doctor blade 35 is attached to a portion of the casing 31 to restrict the thickness of a magnetic brush formed by the developer 32 on the cylindrical sleeve 33 to 1 to 4 mm. A pair of spiral shafts 36 and 37 are arranged in the casing 31, rotating in opposite directions to stir the developer 32 for uniform toner concentration thereof and frictional charging of the toner b. A sponge roller 40 is provided at the outlet portion of the toner hopper 38 to feed the toner b in the toner hopper 38 into the developer reservoir 39.

A magnet 331 with the polarity arrangement shown in FIG. 2 is disposed in the nonmagnetic cylindrical sleeve 33. The developing roller 34 is formed of a cylindrical body 341 made of a conductive material, such as aluminum, and an insulating or resistive layer 342 of epoxy or polyamide resin covering the surface of the cylindrical body 341 to a thickness of 5 to 60 microns.

Figure 3:
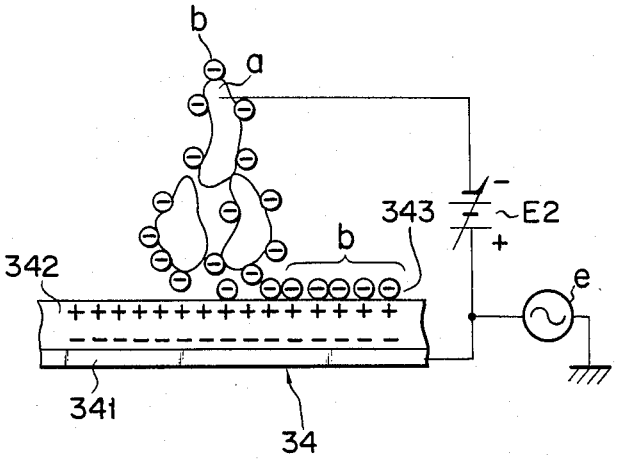
FIG. 3 is a side sectional view illustrating the way toner is attracted to the surface of a developing roller in a normal developing process.

The insulating or resistive layer 342 on the cylindrical body 341 of the developing roller 34 prevents centralization of local current to uniformalize the concentration of the toner b on the developing roller 34 when the toner b is separated by a voltage applied between the carrier a and the toner b, as shown in FIG. 3.

If the layer 342 of the developing roller 34 is a conductive layer, the toner b can be separated satisfactorily. In this case, however, the toner resistance is not expected to attenuate electric charges on the toner b. If the layer 342 is a resistive layer of $10^7$ to $10^{12}$ Ω·cm, attenuation of the charges on the toner b is small, and electric breakdown can be prevented.

The developing roller 34 rotates at a speed substantially equal to or about twice as high as the peripheral speed of the photosensitive drum 2, while the nonmagnetic cylindrical sleeve 33 rotates two or three times as fast as the developing roller 34 in the same or opposite direction.

The cylindrical body 341 of the developing roller 34 is connected to the negative terminal of a first DC power source E1 and the positive terminal of a second DC power source E2, and is grounded through an AC power source e. The positive terminal of the first DC power source E1 is connected to a first fixed contact 411 of a switch 41, while the negative terminal of the second DC power source E2 is connected to a second fixed contact 412 of the switch 41. A movable contact 413 of the switch 41 is connected to the nonmagnetic cylindrical sleeve 33.

Figure 4:
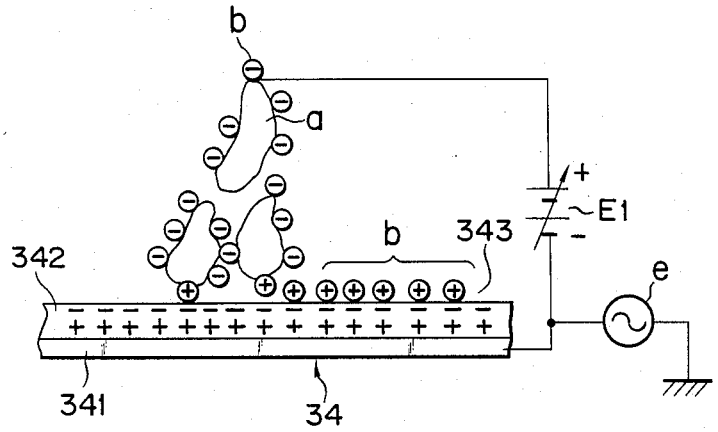
FIG. 4 is a side sectional view illustrating the way the toner is attracted to the surface of the developing roller in a reverse developing process.

Referring now to FIGS. 3 and 4, separation between the magnetic carrier a and the toner b at the region between the developing roller 34 and the nonmagnetic cylindrical sleeve 33 will be described. If the movable contact 413 of the switch 41 is connected to the second fixed contact 412, a DC voltage E2 of 200 to 600 V is applied between the cylindrical body 341 of the developing roller 34 and the cylindrical sleeve 33, as shown in FIG. 3. In this state, positive charges are induced at the superficial portion of the layer 342, and the toner b frictionally charged with a negative voltage in the developer is electrostatically attracted to the layer 342 of the developing roller 34. Thus, a thin toner layer 343 of the nonmagnetic toner b is formed on the developing roller 34. The thickness of the toner layer 343 (which may be adjusted according to the applied voltage) is about 20 to 30 microns, which is equivalent to the thickness of two or three superposed layers of toner with a particle diameter of about 10 microns. The toner layer 343 formed in this manner is separated from the carrier b, and is composed of uniform toner particles with a desired amount of charge. It is known that, if the developing roller 34 and the photosensitive drum 2 face each other with a gap g of 0.2 to 0.7 mm between them in a developing region, then the developing sensitivity obtained is substantially equivalent to the sensitivity achieved by the conventional electrophotographic development process. In this case, the toner b jumps across the gap g, so that the gap g must have a width of approximately 0.4 to 0.5 mm for good resolution. If the AC bias voltage from the AC power source e is adjusted to 0.4 kV to 2 kV to allow the toner b to jump and to provide an electric shaking effect, the picture quality and sensitivity in a low concentration range will be improved.

Thus, according to the developing device 8 of the present embodiment, a nonmagnetic, one-component developer (toner) is supplied to the surface of the photosensitive drum 2 in a noncontact manner so that an electrostatic latent image on the photosensitive drum 2 can be developed. Namely, the developing device 8 enables noncontact development using nonmagnetic toner, which is adapted for color development. Color development requires a plurality of developing devices each using several different kinds of color toners. While it is impossible to tinge the conventionally used magnetic toner with various colors, the nonmagnetic toner can be colored freely and clearly. Moreover, in the conventional developing device using the nonmagnetic toner, magnetic brushes are formed for contact-system development. In this developing system, a magnetic brush for a second color will trace and damage a previously developed image of a first color at the time of developing the second color. According to the prior art system, therefore, a visible image of the second color formed by the second-color developing is transferred to the copying paper in addition to the visible image of the first color. Accordingly, the transfer position of the copying paper must be strictly defined. However, the transfer position may sometimes be shifted and cause shear.

According to the developing device 8 of this embodiment, however, the nonmagnetic toner never comes into contact with the photosensitive drum 2, so that a multitude of colors can be developed on the surface of the photosensitive drum 2 in a superposed manner. Thus, there is no possibility of shear taking place at the time of transfer.

If the movable contact 413 of the switch 41 is connected to the first fixed contact 411, a DC voltage E1 of 400 to 500 V is applied between the developing roller 34 and the cylindrical sleeve 33, as shown in FIG. 4, so that the direction of the electric field and the polarity of the superficial portion of the layer 342 are inverted as compared with the case of the normal developing shown in FIG. 3. In this state, the toner b frictionally charged with a negative voltage in the developer is positively charged by the applied voltage. Thus, the thin film 343 is formed from the positively charged toner b on the developing roller 34.

Figure 5:
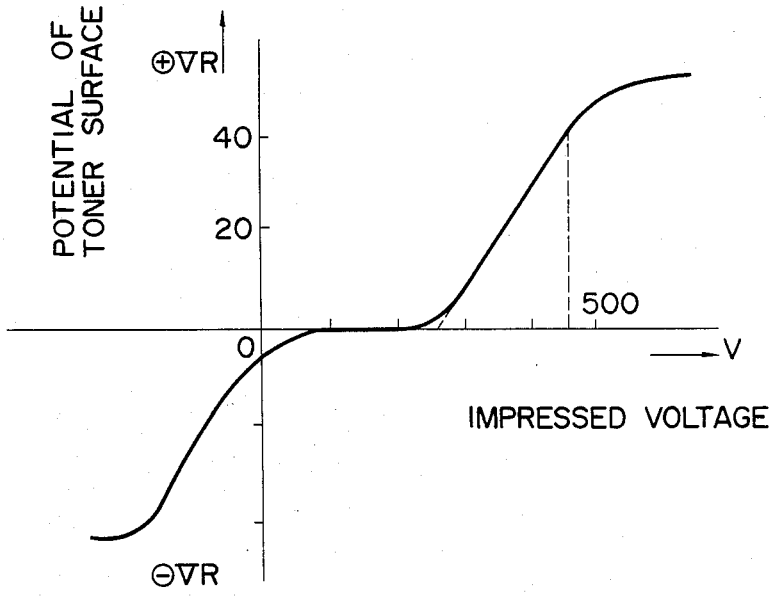
FIG. 5 is a diagram showing the relationship between the voltage impressed between the developing roller and a cylindrical sleeve and the potential of the surface of the toner on the developing roller.

Namely, a DC voltage having a polarity opposite to that for normal developing is applied between the developing roller 34 and the cylindrical sleeve 33. In this case, as is generally known, the toner b never sticks to the developing roller 34, since an electrostatic force is applied to the toner b in such a direction that the toner b is not likely to leave the developer 32. An experiment indicated, however, that, if the applied voltage is gradually increased, the toner b comes to be charged with a positive voltage, inverted at a threshold voltage V1, as shown in FIG. 5. The threshold voltage V1, which depends on the resistance of the toner b and the amount of charge thereon, ranges from 150 V to 350 V for the commonly used toner. Therefore, if a voltage V2 of approximately 400 to 500 V (higher than the threshold voltage V1) is applied from the power source E1, the surface potential of the toner layer 343 on the developing roller 34 rises to about 40 V. Hereupon, the charging polarity of the toner b is inverted for satisfactory reverse development by applying an AC bias from the AC power source e to the positive side for 200 to 500 V.

As it is not influenced by the change from normal to reverse developing, the toner b remaining in the developer (without sticking to the developing roller 34) maintains its original charging polarity (negative). Thus, no difficulties will arise even when the normal development mode is resumed. The polarity of the toner b is inverted for the following reason. If a voltage of 400 to 500 V is applied between the conductive carrier a and the developing roller 34 for the toner b having a small particle diameter of 10 to 15 microns, a high electric field of $4\times10^5$ to $5\times10^5$ V/cm is generated between the carrier a and the roller 34, and charges are injected directly from the carrier a to the toner b by the high electric field. As a result, no electric field is applied to the developer 32 which is not in contact with the developing roller 34, so that the polarity will never be inverted.

The normal or reverse developing operation of the developing device of the aforementioned construction will now be described. In developing a positive electrostatic latent image formed on the photosensitve drum 2, the movable contact 413 of the switch 41 is first shifted to the second fixed contact 412 in the normal development mode. As a result, a DC voltage of 200 to 600 V is applied between the developing roller 34 and the nonmagnetic cylindrical sleeve 33. As the cylindrical sleeve 33 rotates, the toner b frictionally charged with a negative voltage in the developer is electrostatically attracted to the developing roller 34 to form the thin layer 343 thereon. The thin layer 343 of the toner b is brought close to the photosensitve drum 2 for normal developing.

Then, in the reverse developing mode, the movable contact 413 of the switch 41 is shifted to the first fixed contact 411. As a result, a voltage of, e.g., 400 to 500 V having a polarity opposite to that for normal developing is applied between the developing roller 34 and the nonmagnetic cylindrical sleeve 33, that is, between the carrier a and the toner b. As the cylindrical sleeve 33 rotates, the toner b in the developer sticks to the developing roller 34 to form a toner layer thereon. Hereupon, the surface potential VR of the toner layer is about 40 V. The charging polarity of the toner b is inverted for satisfactory reverse developing by biasing the AC bias to the positive side for 200 to 500 V. The positively charged thin layer 343 of the toner b is brought close to the photosensitive drum 2 for reverse developing.

As described above, the rubbing action of the magnetic brush formed of the carrier a and the toner b provides a mechanical "smoothing effect" on the developing roller 34. Thus, the developing device of the present invention can form on the developing roller a uniform toner layer of a minimal thickness such as cannot be obtained with the conventional device. Since the uniform toner layer can be stably formed on the developing roller for a long time, the uniform charging process is greatly improved in reliability, ensuring more consistent picture quality. Moreover, both normal developing and reverse developing can be readily achieved by the use of the same developer. Thus, the developing device of this invention provides noncontact developing which is useful in color image developing, the use of color toner (based on the use of the nonmagnetic toner), the development of intelligent copying machines, etc.

What is claimed is:

1. A developing device adapted to develop an electrostatic latent image on an electrostatic latent image-forming surface of an image carrier by jumping a nonmagnetic toner onto the image-forming surface, comprising:

a casing containing a mixture of the nonmagnetic toner and a magnetic carrier;

a hollow cylindrical body formed of a nonmagnetic material and rotatable in a position such that part of the hollow cylindrical body is buried in said mixture in said casing;

magnet means, contained within said hollow cylindrical body, for forming a magnetic brush comprised of said mixture on an outer peripheral surface of said hollow cylindrical body by the magnetic force of the magnet means when said hollow cylindrical body is rotated;

a rotatable developing roller positioned between said outer peripheral surface of the hollow cylindrical body and said electrostatic latent image-forming surface of the image carrier so as to be adjacent to but separated from the electrostatic latent image-forming surface and so as to be in contact with said formed magnetic brush; and voltage impressing means, electrically connected to the developing roller and the hollow cylindrical body, for generating an electric field between said roller and said body so as to transfer with a predetermined electrostatic charge the nonmagnetic toner portion of said mixture formed on the outer peripheral surface of the hollow cylindrical body onto an outer peripheral surface of the developing roller, whereby said nonmagnetic toner transferred onto the outer peripheral surface of the developing roller is jumped onto the electrostatic latent image-forming surface as the developing roller rotates by virtue of the electrostatic charge imparted to said transferred nonmagnetic toner by said voltage impressing means interacting with the electrostatic charge of said latent image to thereby develop said latent image.

2. The developing device according to claim 1, wherein said developing roller includes a conductive cylindrical base and a layer of a dielectric material formed over an outer peripheral surface of said base, with said voltage impressing means being connected to the developing roller through said base.

3. The developing device according to claim 2, wherein said voltage impressing means includes a DC power source with two ends, each of which are respectively connected to one of said hollow cylindrical body and said base, and an AC power source with two ends, each of which are respectively connected to one of said base and ground.

4. The developing device according to claim 3, wherein said DC power source includes means for selectively delivering at one end of said DC source an output voltage of polarity opposite to that of the predetermined charge imparted to said toner by said voltage impressing means.

5. The developing device according to claim 1, wherein said nonmagnetic toner is colored.

6. The developing device according to claim 1, further comprising stirring means disposed within said casing for stirring said mixture in the casing as to impart frictional charge to said toner.

7. The developing device according to claim 2, wherein said voltage impressing means includes a first DC power source whose negative electrode is connected to said base, a second DC power source whose positive electrode is connected to said base, and a changeover switch one end of which is connected to said hollow cylindrical body, and the other end of which is selectively connectable to one of the positive electrode of the first DC power source and the negative electrode of the second DC power source.

8. The developing device according to claim 6, wherein said volatge impressing means further includes an AC power source having two ends which are each respectively connected to one of said base and ground.

* * * * *